United States Patent [19]

Nunan

[11] 4,379,421

[45] Apr. 12, 1983

[54] ELECTRICAL PICKUPS

[76] Inventor: Kevin N. G. Nunan, Lake Cottage, Stoke Rd., Bishops Cleeve, Cheltenham, Gloucestershire GL52 4RP, England

[21] Appl. No.: 312,124

[22] Filed: Oct. 16, 1981

[30] Foreign Application Priority Data

Oct. 22, 1980 [GB] United Kingdom ..... 8033999

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS 3,915,048 10/1975 Stich ..... 84/1.15 X

*Primary Examiner*—Stanley J. Witkowski

*Attorney, Agent, or Firm*—Allison C. Collard; Thomas M. Galgano

[57] ABSTRACT

An electrical pickup for a stringed musical instrument comprises a cylindrical permanent magnet and a coil surrounding the magnet and wound lengthwise thereof. The ends of the magnet are fixed to two rigid mounting wires, and the coil is wound on a former comprising a central tubular core and two parallel plates fixed to the tube on diametrically opposite sides thereof. The tube, and thus the former and coil as a whole, can turn on the magnet. The magnet is magnetized so that the magnetic poles thereof are positioned at diametrically opposite edges of the magnet, i.e. at the ends of a diameter of the circular cross-section of the magnet cylinder. Thus the former and coil can be turned between two positions 180° apart in order to reverse the winding direction of the coil around the fixed magnetic axis H of the magnet.

9 Claims, 4 Drawing Figures

ELECTRICAL PICKUPS

BACKGROUND OF THE INVENTION

1. Field of the Invention

This invention relates to electrical pickups for stringed musical instruments and comprising a coil wound around a permanent magnet.

2. Description of the Prior Art

Modern stringed musical instruments are commonly fitted with such electrical pickups, this being particularly the case with guitars as used for the playing of so-called "pop" music. With such a guitar what is referred to as the tonal variety thereof is fundamentally determined by the actual type of pickup used. The pickups at present in use may be categorised as being of either "hum-bucking" or single-coil type.

A hum-bucking pickup, sometimes referred to as "a hum-bucker" is a twin unit with two coils wound in opposite directions relative to their respective magnets—the coils may be wound in the same direction and the magnets oppositely orientated, or the coils may be wound in opposite directions and the magnets similarly orientated. With such a pickup the coils can be connected to a pre-amplifier so that any mains voltage hum or radio interference induced in one of the coils is cancelled out by that induced in the other. A single-coil pickup, as its name implies, consists of a single coil wound around a fixed magnet.

Guitars are commonly fitted with two or even three pickups spaced longitudinally of the strings below the latter, these pickups being selectively switchable to change the musical characteristics of the amplified sound produced by the instrument. One, or more, of these pickups may be of hum-bucking type, but each is essentially of one type or the other. Even when two single-coil pickups are switched for use together, connected to the same pre-amplifier input, they cannot operate as a hum-bucking arrangement because they both have the same coil/magnet orientation. This limits the range of tonal variety obtainable.

SUMMARY OF THE INVENTION

The principal object of the invention is to provide an electrical pickup which can alternatively operate, as desired, as either a single-coil pickup or as one half of a hum-bucking pickup arrangement.

According to the invention an electrical pickup assembly comprises an elongate permanent magnet magnetized so that the magnetic poles thereof are respectively positioned at opposite side edges of the magnet, and a coil surrounding and wound lengthwise around the magnet, i.e. so that the longitudinal axis of the magnet lies generally in the winding plane of the coil, the magnet and coil being relatively rotatable about said longitudinal axis and the assembly having mounting means so that it can be fixed to an instrument without impeding said relative rotation of the magnet and coil through at least an angle of 180° at the limits of which a magnetic axis of the magnet is aligned with the winding axis of the coil.

Thus relative rotation of the magnet and coil through said angle of 180° effectively reverses the orientation of the coil relatively to the magnet. In either of these relative positions the pickup will operate as one of single-coil type but when fitted as one of two pickups of an instrument it can be adjusted to the position in which, in combination with the other, it will provide a hum-bucking arrangement.

Although either the magnet or the coil can be fixed, and the other one thereof rotatable, it is preferred that the magnet should be fixed with the coil freely rotatable relatively thereto. Thus the mounting means may be fixed to the magnet and arranged to mount the pickup so that the magnet extends transversely of and below the strings with the magnetic axis perpendicular to the plane of the strings.

The coil is preferably wound on a former which is directly and rotatably mounted on the magnet. Thus the magnet, which essentially differs from the rod or bar magnets conventionally used in having side edge poles instead of end poles, may conveniently be of circular cross-section which fits within a circular tubular core of the rotatable former which thus turns on the magnet. However, it will be appreciated that an elongate magnet of any cross-sectional shape may be used.

A pick-up in accordance with the invention may be a component of an instrument manufactured to embody the invention initially and including two or more pick-ups at least one of which has a relatively rotatable coil/-magnet assembly as described. Alternatively, the pickup may be designed as a replacement unit for fitting in place of an existing instrument pickup. In this case the dimensions of the assembly, and the fixing means thereof, can be chosen so that it is a direct replacement utilising the original mounting recess and fixings on the instrument. The pickup can further be designed for wiring into the existing switch(es) and potentiometer(s) of the instrument.

Detent or like means may be embodied which define, and releasably retain, the two operative positions of the coil 180° apart.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
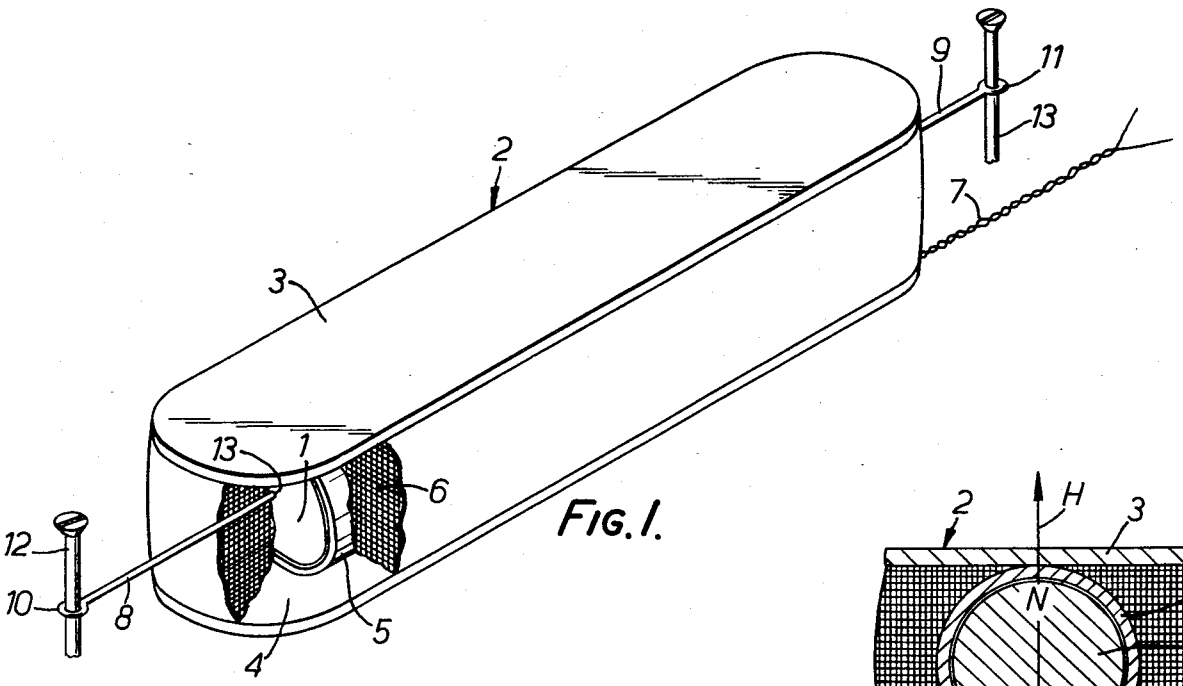
FIG. 1 is a perspective and somewhat diagrammatic view of a preferred embodiment of the invention, with a coil thereof partly cut away.
Figure 2:
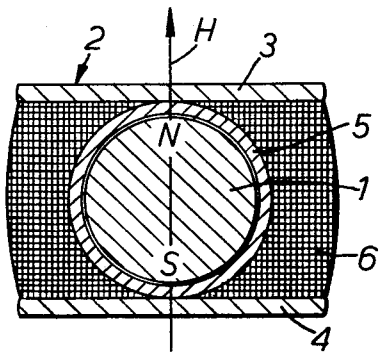
FIG. 2 is a lateral cross-sectional view thereof.

The assembly illustrated in FIGS. 1 and 2 comprises an elongated permanent magnet 1 of cylindrical shape, magnetized so that the magnetic poles N and S are respectively disposed at opposite side edges thereof, i.e. top and bottom edges as marked in FIG. 2, producing the magnetic field H. A coil former 2 comprises parallel elongate plates 3 and 4 secured to a tube 5 which is the same length as the magnetic 1 and is a close fit while being freely rotatable thereon. The plates 3 and 4, and the tube 5, are of electrically insulating plastics material. A coil 6 is wound on the former 3, between the plates 3 and 4 lengthwise of the magnet, i.e. the winding plane of the coil 6 is parallel to the plates 3 and 4 and the winding axis is aligned with the magnetic axis of the magnet 1. The coil is closely wound on the former 2 with a large number of turns, say about 7000 turns, and end connections are brought out as a twisted pair 7 at one end of the coil winding.

Mounting means of the assembly are provided by rigid end wires 8 and 9 which are aligned with the longitudinal cylinder axis of the magnet 1 and terminate in end loops 10 and 11 to receive fixing screws such as 12 and 13. The latter screw into mountings on the guitar body to fix the magnet 1 in the orientation illustrated. The wires 8 and 9 pass with clearance through the ends of the coil 6, so as to allow the required rotation of the coil and former, and they are cemented into axial blind bores 13 in the magnet 1. In FIG. 1 the coil 6 is cut away at one end to show the fixing of the wire 7 to the magnet 1, the other end mounting connection being identical.

Figure 3:
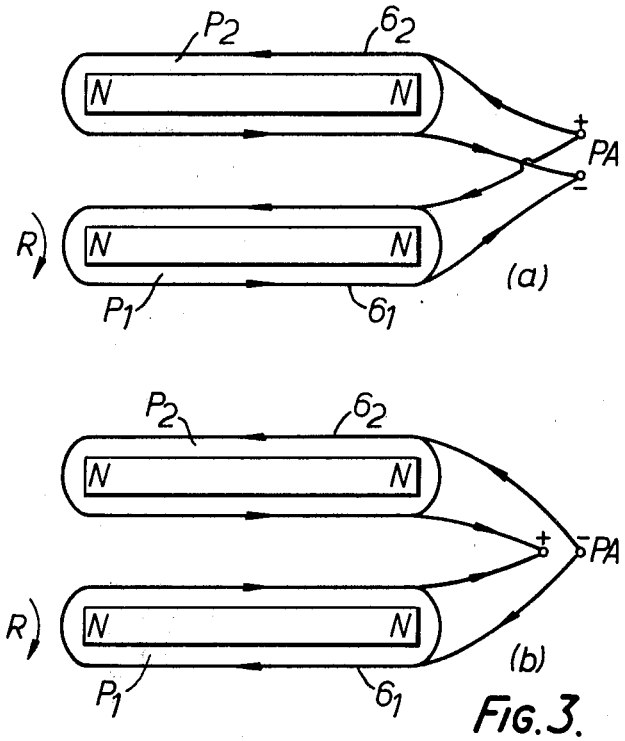
FIG. 3 illustrates alternative interconnections of two pickups, one of which embodies the invention.

FIG. 3 diagrammatically shows alternative ways in which two pickups $P_1$ and $P_2$ can be interconnected to a pre-amplifier (not shown) at PA. The respective winding directions of the two coils $6_1$ and $6_2$ are indicated by arrow heads, in FIG. 3(*a*) the coils being wound in the same direction and in FIG. 3(*a*) in opposite directions. However, in each case the interconnection of the coils $6_1$ and $6_2$ is such that their outputs are additive in phase and induced 50 or 60 Hertz mains hum or radio interference is not cancelled out. Although the two pickups $P_1$ and $P_2$ are of identical electro-magnetic characteristics only one of them, say $P_1$, need be in accordance with the invention and have a rotatable coil/former subassembly which turns as shown by the arrow R. With wither of the two interconnection arrangements shown, turning the coil $6_1$ through 180° will result in the winding direction being reversed so that any mains hum or radio interference induced in the coils will cancel out and a hum-bucking pickup arrangement results.

Figure 4:
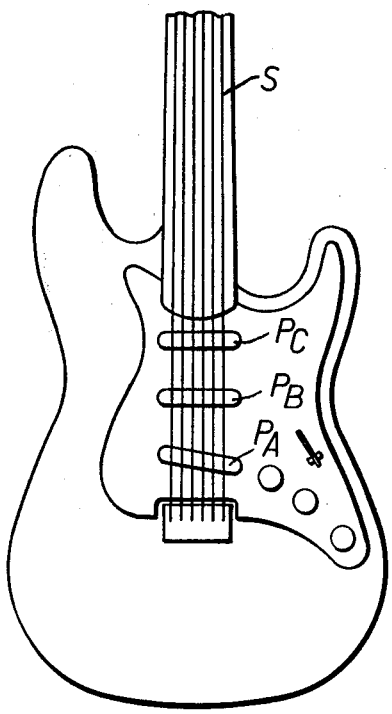
FIG. 4 is a diagrammatic view of a typical guitar arrangement with which the invention may be employed.

FIG. 4 illustrates a known guitar configuration with three single-coil pickups $P_A$, $P_B$ and $P_C$ mounted immediately below the strings S. The pickups are arranged as shown and the magnets thereof produce magnetic fields in which the strings when plucked vibrate, thereby inducing corresponding voltage signals in the pickup coils which can be amplified by a pre-amplifier/amplifier arrangement (not shown). The pickups are selectively switchable to provide a range of five sound variations, namely:

| Switch Position | Connected | Sound |
|---|---|---|
| 1 | $P_A$ | Single-coil |
| 2 | $P_A$ and $P_B$ | Characteristic "out-of-phase" |
| 3 | $P_B$ | Single-coil |
| 4 | $P_B$ and $P_C$ | Characteristic "out-of-phase" |
| 5 | $P_C$ | Single-coil |

If the pickup $P_B$, for example, is replaced by a pickup in accordance with the invention the same five variations are obtainable with the rotatable coil in a corresponding position to that of the replaced standard pickup, which may be referred to as the 0° position. Turning of the coil of $P_B$ to what may be referred to as the 180° position and utilising the same five-position switching arrangement now provides two further sound variation combinations, namely—

| Switch Position | Connected | Sound |
|---|---|---|
| 2 | $P_A$ and $P_B$ | Hum-bucking |
| 4 | $P_B$ and $P_C$ | Hum-bucking |

Thus, the invention allows the range of obtainable sound variations to be materially increased wiht a hum-bucking facility at switch positions 2 and 4, the sound being unchanged in switch positions 1, 3 and 5 whether the rotatable coil of the invention is at the 0° or 180° position.

The significance of the sound characteristics referred to in the foregoing tables will be clear to those skilled in the art. The different types of sound produced are difficult to describe in words, but in simple terms a single-coil pickup produces a rather "thin" sound in that it is a clear sound with a predominantly treble response. However, the precise characteristics will depend upon the position at which the pickup is situated. Near to the bridge of the guitar there is a higher treble response due to a predominance of harmonics from the strings themselves. Near the base of the neck of the guitar the sound has a greater bass characteristic due to a lack of harmonics and a predominance of the fundamental notes of the strings.

The "out-of-phase" sound also referred to is particularly hard to describe in words, although instantly recognisable by guitarists. The characteristic is that the middle frequencies are cut and the harmonics emphasised. The third sound as produced by a hum-bucking arrangement is subjectively more "powerful" than the other two—the output voltage is generally higher, with the bass and middle frequencies emphasised and with the treble response cut. Furthermore, a note will generally be sustained longer than with a single-coil response.

A pickup in accordance with the invention can readily be designed, as regards its dimension and mounting means, so that it is a direct replacement for a standard fixed coil and magnet pickup. It can be used in either coil position on its own, that is a single-coil pickup, or interconnected with another pickup to provide a hum-bucking arrangement.

Furthermore, a stringed instrument possessing one single-coil pickup and one twin-coil (hum-cancelling) pickup, can have the single-coil pickup replaced by a pickup in accordance with the invention. This simple replacement enables the instrument to reproduce further sound variations. Also, a standard instrument possessing two or more single-coil pickups can have one of them replaced by a pickup in accordance with the invention, thereby enabling the instrument to reproduce a sound very similar to that produced by a twin-coil pickup.

I claim:

1. An electrical pickup assembly for a stringed musical instrument, comprising an elongate permanent magnet which is magnetized so that the magnetic poles thereof are respectively positioned at opposite side edges of the magnet, and a coil surrounding and wound lengthwise around the magnet, the magnet and coil being relatively rotatable about a longitudinal axis of the magnet and the assembly having mounting means so that it can be fixed to an instrument without impeding said relative rotation of the magnet and coil through at least an angle of 180° at the limits of which angle a magnetic axis of the magnet is substantially aligned with the winding axis of the coil.

2. A pickup assembly according to claim 1, wherein the magnet is fixed relatively to said mounting means of the assembly and the coil is rotatable.

3. A pickup assembly according to claim 2, wherein said mounting means comprise rigid end mounting wires the inner ends of which are respectively fixed into the ends of the magnet and which terminate in outer end loops to receive fixing screws.

4. A pickup assembly according to claim 2, wherein the coil is wound on a former which is directly and rotatably mounted on the magnet.

5. A pickup assembly according to claim 1, wherein the magnet is of cylindrical shape so that the N and S poles of the magnet are respectively positioned at opposite ends of a diameter of the circular cross-section of the magnet.

6. A pickup assembly according to claim 4, wherein the former has a central tubular core which fits closely on the magnet while being freely rotatable thereon.

7. A pickup assembly according to claim 6, wherein the former comprises two parallel elongate plates fixed to said tubular core, these plates and the tubular core being of electrically insulating plastics material.

8. A pickup assembly according to claim 1, embodying indexing means which define said angle of 180° and releasably retain the coil relatively to the magnet at the limits thereof.

9. A pickup assembly according to claim 1 fitted to a stringed musical instrument, wherein the pickup is one of three electrical pickups fitted below the strings of the instrument, spaced lengthwise of the strings and extending transversely thereof, and at least the middle one of said three pickups is an assembly in accordance with claim 1.

* * * * *